United States Patent [19]

Knox et al.

[11] 4,075,033

[45] Feb. 21, 1978

[54] WIPING MATERIAL AND HOLDER

[76] Inventors: Michael A. Knox, 320 W. Normal Parkway, Chicago, Ill. 60621; Mary Powers, P.O. Box 588, Cedar Falls, Iowa 50613

[21] Appl. No.: 712,653

[22] Filed: Aug. 9, 1976

[51] Int. Cl.[2] ..... A47K 10/16; A61M 35/00; B08B 1/00

[52] U.S. Cl. ..... 134/6; 15/210 R; 15/223; 15/244 B; 128/269

[58] Field of Search ..... 134/6, 8; 15/209 R, 15/210 R, 223, 244 R, 244 B; 128/2 W, 260, 269, 271; 132/79 D, 88.7, DIG. 3; 229/1.5 B, 3.1, 3.5 R

[56] References Cited

U.S. PATENT DOCUMENTS

| | | | |
|---|---|---|---|
| 2,131,077 | 9/1938 | Snyder | 132/88.7 |
| 2,610,347 | 9/1952 | Kleiner | 15/210 R |
| 2,635,274 | 4/1953 | Hatcher et al. | 15/210 R X |
| 2,666,224 | 1/1954 | Adams | 15/210 R X |
| 2,816,312 | 12/1957 | Beck et al. | 15/210 R |
| 2,983,944 | 5/1961 | Uselis | 15/244 R |
| 3,144,971 | 8/1964 | Wommelsdorf | 229/3.5 R |
| 3,211,145 | 10/1965 | Rosenthal | 15/210 R X |
| 3,221,356 | 12/1965 | Schirmer | 15/210 R |
| 3,786,807 | 1/1974 | Dubin | 128/260 X |

*Primary Examiner*—Richard V. Fisher
*Attorney, Agent, or Firm*—Eugene F. Friedman

[57] ABSTRACT

A wiping material in the shape of a cup and a handle for holding the material during its use. The wiping material may include several layers with the same or different compositions. For hygienic use, it may have a layer of soft, absorbent toilet paper with, perhaps, an innermost layer of a moisture-impermeable material. The handle typically fits inside of and grasps onto the cup-shaped wipe. Conveniently, a compressible sponge on the end of the handle and slightly larger than the inside of the wiping material retains the material for use. The handle may also eject the wipe after such use. A plunger connects to a shaft in the handle which in turn connects to a washer or some other surface near the sponge. Depressing the plunger moves the cone of material off the sponge where it may fall into some receptacle. A spring within the handle biases the plunger and shaft back into its former position. Utilizing the combination involves placing the handle next to the cone of material and connecting the two together. Moving the handle then allows the web of material to contact and treat the desired surface. Subsequently, the web disengages from the handle, preferably without contacting the wiping material itself.

11 Claims, 6 Drawing Figures

11
12
13
14
15
22
23
31
32
2

33
35
12
32
31

12
33
15
21
20
23
22
14
31
26
25
38
32
16
13
23
21
22

34
32
35
33
41
21
13
22
23
14
31
26
25
12
15
16
20
21
22
23

43
42

15
21
20
26
25
52
51
50

WIPING MATERIAL AND HOLDER

BACKGROUND OF THE INVENTION

Rolled toilet paper has found generally universal acceptance in the civilized world for the usual hygienic purposes. On occasion, various public facilities have instead employed separate sheets of paper. In any event, the use of such wiping material generally involves placing together several layers of the particular material. The individual then places the multi-layered wad of paper in contact with the portion of the anatomy requiring cleansing. The movement of the paper in a generally linear direction hopefully effects removal of most of the undesired detriments to cleanliness. The paper itself, of course, provides the sole barricade between such contaminants and the individual's hand and fingers.

The above procedure, though universally used, suffers from a plethora of undesirable and disturbing shortcomings. Yet, it continues to plague the mass of civilized humanity committed to its use.

Much of the paper used during the hygiene procedures does not actually cleanse the desired area. Most of its serves a different purpose, if any at all. For example, a portion of the paper simply allows the hand to hold it. Much of the paper attempts to shield the rest of the hand, although not involved in holding the paper, from the filth involved. A good portion of the paper has no use, but rather results from the requirements or desire to place it in the cylindrical roll form. Moreover, a part of the paper employed simply provides some assurance to the user of sufficient layers to prevent its breaking at an impropitious moment.

The use of an amount of material vastly in excess of that required becomes even more burdensome in these days of shortages of paper fiber. Nonetheless, the waste of a large fraction of the paper made into this form continues.

Even with an abundance of the paper material, the many layers can, on occasion, saturate with moisture and rupture. This allows contaminants to attack the hand and the surrounding clothing of the individual involved. Even without tearing, some contaminants can escape around the side of the paper to dirty the individual's hands and clothing.

The problems alluded to above represent, at best, a major inconvenience for a person cleaning himself. For an individual attending to another, such as an infant or an invalid, the undesirable aspects of the situation become intolerable.

Situations other than hygienic cleansing also require wiping with various materials. The cleaning or polishing of inanimate objects represents one such use of material. However, the cloth or other material employed in these circumstances again generally takes the form of a flat sheet. While the thumb and the palm of the hand attempt to hold onto it, the fingers attempt to use its remaining portion for the intended job. Again, the procedure uses an excess amount of material than that actually needed. Moreover, the material may degenerate or tear leaving the fingers exposed to undesirable substances. In addition, the fingers may be too large or lack the shape for the task at hand, such as cleaning the interstitial spaces of an automobile grill.

As the foregoing discussion shows, people have suffered through the use of toilet paper and other wiping materials for extended periods and to an umlimited degree. Nonetheless, the serious severe problems inherent in their use remain to this day. Providing a solution to these problems would hold the prospect of benefitting untold numbers of people.

SUMMARY

Holding the wiping material with an appliance rather than a person's hand obviates many, if not all, of the difficulties associated with the latter. To accomplish its objective, the appliance should have some form of handle which a person may hold. It should also possess a grasping device coupled or connected to the handle to retain the web of wiping material in a fixed position relative to the handle. The appliance may also include a removing device to effectuate the disengagement of the web of cleaning material after its use.

The material itself may take most any form. However, additional benefits accrue where it assumes the shape of a cup. This allows an appropriately sized and shaped appliance to fit inside of the wiping material and support and hold onto it at that location. The outside of the material remains free to perform its desired function. The removing device may similarly operate upon the inside of the cup-shaped web of wiping material to remove it from the appliance. This arrangement dispenses with any need whatsoever for touching the outside of the material after its use.

The cup-shaped web may, furthermore, include several layers of material held together in some fashion. Each layer may have the same composition as the others. For example, for hygienic uses, each layer may be formed from soft toilet paper. Alternatively, the layers may have different compositions. For example, for hygienic uses again, the innermost layer may possess moisture impermeability. This would prevent liquid waste from passing through the entire web to soil the appliance itself.

As one specific form, the appliance may include an elongated handle having a compressible sponge connected to its end. The sponge should have an uncompressed size somewhat larger than the bottom of the inside of the web of material. Placing the sponge into the cup of material compresses it. Due to its natural resiliancy, it then pushes outwardly against the inside of the web of material and holds it in place through friction.

The removing device may take the form of a plunger attached to the end of the handle away from the sponge. The plunger connects to a shaft inside the handle. The shaft terminates, at its other end, in a surface which can contact a web of material on the appliance. Depressing the plunger causes the surface to move the web of material off the sponge and out of engagement with the appliance. The handle may also include a spring to force the plunger out of the handle. Alternatively, placing a new web of material on the sponge may move the plunger back to its extended position.

The appliance considerably reduces the amount of material required for the usual tasks. The need for the excess to protect the entire hand and to provide a portion to fit between the thumb and the rest of the hand for holding disappears. The material for actually wiping or treating the surface represents the only amount necessary.

Moreover, the appliance removes the hand from near the surface receiving treatment or cleaning. This reduces the likelihood of soiling the hand or possibly the cuff of a shirt or blouse.

Further advantages result from the use of a moisture-impermeable layer, such as polyethylene, on the inside of a cup of material. For example, it may allow the use of a solution to wash an area rather than merely dry wiping it, as customary now.

The cup-shaped material with its appliance may conveniently apply medication to various portions of the body. The cone of material may acquire the medication either by dipping into it or having some placed on its exterior. Applying the medication to the needing area represents a very simple and straight forward task. Using toilet paper, in comparison, presents an almost insurmountable task both in applying medication to the paper and then to the anatomy. People frequently dispense with such paper altogether.

The sponge on the appliance supporting the wiping material can provide a soft cushion and result in less abrasion or irritation to the affected area. Moreover, the cone of paper on this cushion generally has a smoother surface than the currently employed wad of toilet paper taken from a roll. For this reason too, it will tend to abrade less the sensitive portions of the anatomy involved. This becomes particularly advantageous to persons having minor but sensitive abnormalities in that particular area. The paper may even have a softer construction than the usual toilet paper since it need not withstand the force of fingers pushing against it.

The wiping material may also have different compositions, sizes and shapes depending upon the particular need. For example, a smaller cone of material and a smaller applicator may possess greater suitability for an infant than for an adult. It can also find particular use in cleaning areas not readily reached by the hand. For example, a square appliance with square wiping material may treat inanimate surfaces with small corners such as the grill work of an automobile or the spokes of a wheel.

DETAILED DESCRIPTION

Figure 1:
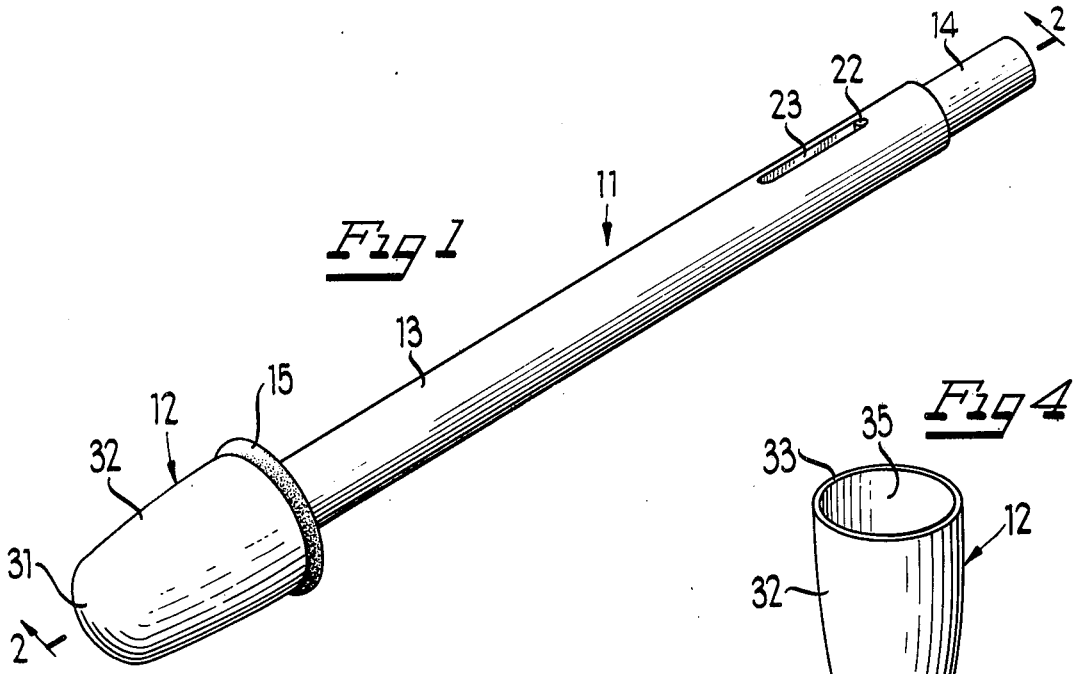
FIG. 1 shows an appliance for holding a cup-shaped web of material.

In FIG. 1 appears generally an appliance 11 for holding the cup-shaped web of material 12. The appliance 11 includes the elongated cylinder 13 which acts as its handle. From one end of the handle 13 extends the plunger 14 which effectuates the removal of the cone 12 from the appliance 11.

Figure 2:
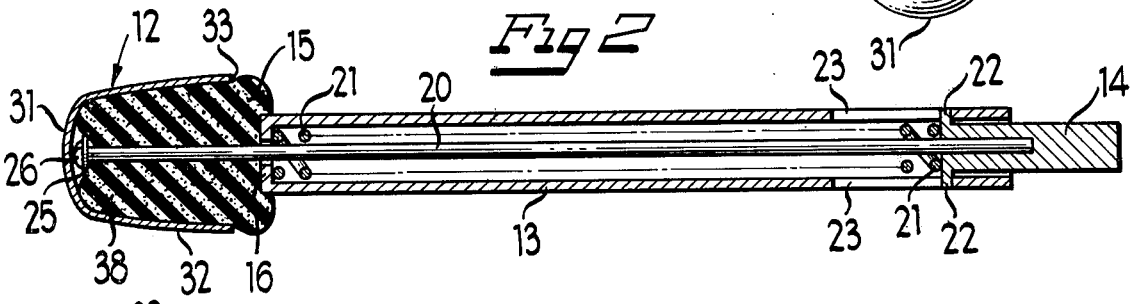
FIG. 2 provides a cross sectional view along the line 2—2 of the appliance and web of material of FIG. 1.

Attached to the other end of the handle 13 lies the sponge 15, part of which appears outside of the top edge of the web 12 in FIG. 1. The cross sectional view of FIG. 2 shows the full extent of the sponge 15. As shown there, the sponge 15 attaches to the end 16 of the handle 13. A suitable adhesive may join the two together. Alternatively, the handle 13 may run through the inside of the entire length of the sponge 15 for a more secure union between the two.

The handle 13 itself takes the shape of a hollow cylinder. Through it passes the shaft 20 which rigidly connects at one of its ends to the plunger 14. The spring 21 extends between the end 16 of the handle 13 and the plunger 14 to bias the latter to the right in FIG. 2. The projections 22 on the plunger 14 extend through the elongated openings 23 in the handle 13. The abutting of the projections 14 against the rearward limit of the openings 23 prevents the total egress of the plunger 14 from the handle 13.

Figure 3:
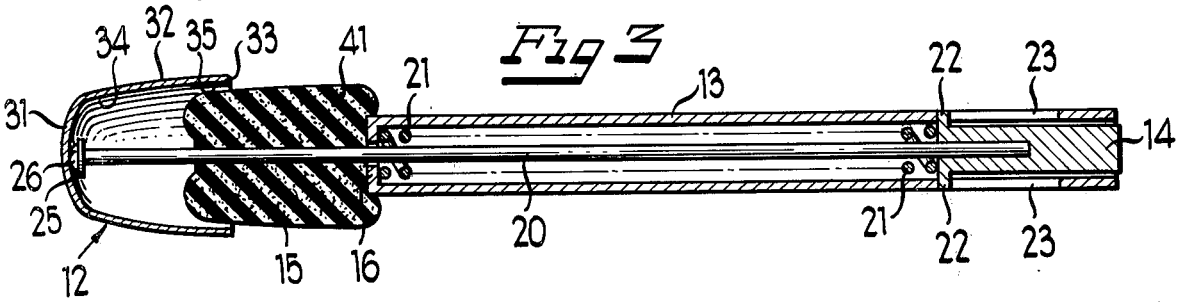
FIG. 3 has a similar view to that of FIG. 2 but with the ejector removing the web of material from the appliance.

Depressing the plunger 14 into the handle 13 moves it to the left, as FIG. 3 shows. The shaft 20, at its left end, terminates at the washer 25 which the screw 26 holds to it. Consequently, the motion of the shaft 20 to the left causes the washer 25 and the screw 26 to move in that direction. As they do, they contact the cup-shaped web of material 12 and move it to the left relative to the sponge 15. Eventually, the sponge will no longer press against the sides of the cone 12. At this point the cone 12 disengages from the sponge 15 and, thus, the appliance 11.

Many materials suffice for the appliance 11. It should possess sufficient rigidity to allow the appliance 11 to support the cup-shaped material 12 during the wiping, cleaning, or polishing operation undertaken. For the handle 13, a rigid plastic or even a stiff cardboard material will perform satisfactorily. The same type of material will suffice for the plunger 14 and the shaft 20. Additionally, the shaft 20 may have a composition of wood. The screw 26 and the shaft 20 may be formed from a metal or plastic, as examples of suitable materials.

After the washer 25 and the screw 26 has removed a web 12 from the sponge 15, the operator removes his finger or thumb from the plunger 14. At this point, the extensive force on the spring 21, operating between the end 16 of the handle 13 and the plunger 14 forces the plunger 14 to its extended position. This motion of the plunger also takes the shaft 20, the washer 25, and the screw 26 back to the position shown in FIG. 2.

However, the appliance 11 can perform satisfactorily without the spring 21. In this case, the shaft 20, the washer 25, and the screw 26, after discarding a web of material 12, will remain extended from the end of the sponge 15. However, inserting the appliance 11 into a further cone of material 12 forces these elements and the plunger 14 back to the right, the position of FIG. 2.

Figure 4:
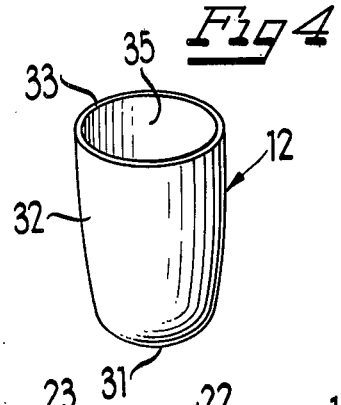
FIG. 4 gives an exterior view of a cup-shaped web of material standing alone.

The web of wiping material has an overall cone or cup-shaped as shown in cross section in FIGS. 2 and 3 and from the exterior in FIG. 4. The bottom 31 of the cup 12 connects to the side 32. The side 32, in turn, terminates at the outside edge 33. The inside of the side 32 is smaller at its bottom 34, where it joins the bottom 31, than at its top 35 near the ridge 33. Moreover, the inside of the side 32 tapers from the bottom 34 to the top 35.

This arrangement proves particularly convenient for inserting the appliance 11 into the cone of material 12. As the insertion begins, the sponge's end 38 furthest from the handle 13 enters the web 12 readily since it has a dimension about the same as the web's top 35. As the sponge 15 further enters the cone 12, its end 33 compresses due to the inwardly sloping inside wall 32 of the web 12. When fully inserted into the web 12, the sponge 15 has undergone substantial compression especially near its distal end 38. The compressed sponge at this point exerts an appreciable lateral force against the inside of the side 32. This force, along with the soft, somewhat tacky character of the exterior of the sponge 15, creates a frictional force between the sponge 15 and the web 12. This force keeps the cone 12 properly positioned on the appliance 11.

When a sponge holds the web of material 12, its size should permit its facile insertion into the web. Preferably, its uncompressed size should at least enter the top 35 of the web 12 without substantial compression. To retain the web 12 in place, the sponge's distal end 38 should generally have an uncompressed size substantially larger than the inside of the bottom 34 of the side 32. The resulting compression of the sponge 15 creates the frictional force against the side 32 of the web 12 to retain it in place.

However, other shapes could work for both the web 12 and the sponge 15. For example, the sponge's end 41 near the handle 13 may have edges parallel to the handle 13 with the distal end 35 tapering inward as in FIGS. 2 and 3. The top portion 35 of the cone 12 may curve inwardly, rather than tapering outwardly. This would effectuate a slight grabbing of the sponge 15 by the outside end 35 of the web 12.

The web 12 may have a single layer of material as shown in FIGS. 2, 3 and 4. Alternatively, several layers adhered together may provide a superior product for various applications. For use in personal hygiene, smooth, soft, and absorbent toilet paper will function satisfactorily for these layers.

Figure 5:
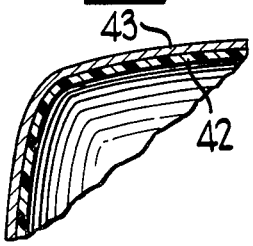
FIG. 5 gives a partial cross sectional view of a web of material with a plurality of layers with different compositions.

FIG. 5 shows part of a web 12 having two layers 42 and 43 of different composition. Again, for hygienic use, the outer layer 43 may consist of toilet paper or some other similar absorbent material. The innermost layer 42, however, may have a moisture-impermeable composition. This inner layer 42 would then protect the sponge 15 from contamination due to dirt with a liquid component passing through the web 12. If desired, the web 12 may include several layers of either or both materials shown for the inner layer 42 and the outer layer 43. It may also include one or more layers of a third composition.

The cone of material 12 may display various colors or designs where the intended use would suggest some decoration. Certainly, its use in the bathroom or for an infant would indicate such pleasing aspects. Furthermore the size and shape of the appliance 11 and the cup 12 admit of variations for different uses. By way of example, they may have a smaller size for an infant than for an adult.

The moisture-impermeable layer 42 may also allow the use of the web 12 with such solutions as cleaning or moisturizing solutions without fear of them soiling the sponge 15. The inner layer 42 may also have sufficient strength to allow a very soft outer layer 43 which can avoid the discomfiture that a stiffer material would cause an individual.

Figure 6:
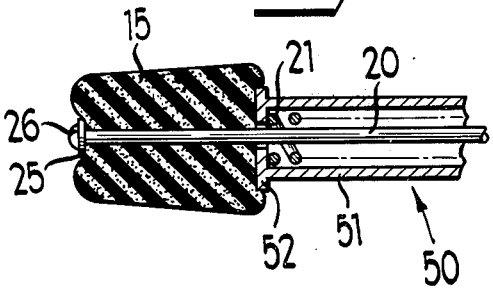
FIG. 6 shows a part of an appliance with a modified end of the handle section.

FIG. 6 shows the end of an appliance 50 very similar to the appliance 11 of FIG. 1. The handle 51, however, has the table-like platform extending laterally where it adjoins the sponge 15. This projection 52 simply gives further support to the sponge 15 during its insertion into a web of material 12.

Accordingly, what is claimed is:

1. A method of treating a surface which comprises:

(A) placing in proximity to each other a cup-shaped web of at least two layers of substantially non-resilient flexible material and a grasping means connected to one end of an elongated handle means said grasping means having a resilient surface contacting said web;

(B) retaining with said grasping means said web at a fixed orientation relative to handle means;

(C) moving said handle means with said web retained by said grasping means so as to contact said surface with said web; and (D) subsequent to the step of contacting said surface with said web, disengaging said web from said grasping means without manually touching the outside of said web.

2. The method of claim 1 wherein the retaining of said web with said grasping means includes inserting said grasping means and the end of said handle means with said grasping means into the inside of said cup-shaped web.

3. The method of claim 2 wherein the step of disengaging said web from said handle is accomplished without contacting the outside of said web.

4. A combination used for treating a surface comprising:

(A) a web having at least one layer of substantially non-resilient flexible material and being cup-shaped in overall configuration with an open end, a closed end, and a side; and (B) an appliance including:

(1) an elongated handle means for allowing the holding of said appliance;

(2) grasping means, coupled to one end of said handle means and of a size to fit inside of said web, for contacting and retaining said web in a position having a substantially predetermined fixed orientation with respect to said handle means said grasping means having a resilient surface contacting said web and (3) removing means coupled to said holding means for disengaging said web from said grasping means.

5. The combination of claim 4 wherein said removing means disengages said web from said grasping means by contacting only the inside of said web.

6. The combination of claim 5 wherein said grasping means has a larger cross-section than said handle means and retains said web by pressing in an outward direction and exerting a frictional force against the inside of the side of said cup-shaped web.

7. The combination of claim 6 wherein said grasping means includes a compressible sponge having an uncompressed size larger than the bottom of the inside of said cup-shaped web.

8. The combination of claim 7 wherein said removing means includes:

(1) pushing means for (a) making contact with the inside of a web retained by said grasping means and (b) moving said web in a direction away from said handle for a sufficient distance to effectuate disengagement of said grasping means with said web; and (2) actuating means connected to said pushing means located at least in part in proximity to said handle means at a position removed from said grasping means for imparting motion to said pushing means in a direction to move said web away from said handle means.

9. The combination of claim 8 wherein (a) said actuating means includes a rod within said handle and a plunger rigidly connected to or forming part of said rod and extending out to the exterior of said handle means, said rod being long enough and said rod and said plunger being movable in a direction so as to extend the end of said rod, near the end of said handle means with said grasping means, beyond the end of said handle means, and (b) said pushing means includes a surface connected to and movable by said rod for making contact with a web retained by said grasping means.

10. The combination of claim 9 wherein the inside of said web is smaller at the closed end than at the open end and the inside of said side tapers outwardly from the closed end to the open end.

11. The combination of claim 10 wherein the outermost layer of material of said cup-shaped web is absorbent to aqueous solutions and one of said layers is moisture impermeable.

* * * * *